US005129796A

United States Patent [19]

Emmert et al.

[11] Patent Number: 5,129,796

[45] Date of Patent: Jul. 14, 1992

[54] AUTOMOTIVE FUEL PUMP

[75] Inventors: Dan H. Emmert, Grand Blanc; John E. Creager, Linden, both of Mich.

[73] Assignee: General Motors Corporation, Detroit, Mich.

[21] Appl. No.: 657,695

[22] Filed: Feb. 19, 1991

[51] Int. Cl.[5] ..... F04B 39/12

[52] U.S. Cl. ..... 417/435; 417/423.3; 417/423.5; 417/251; 415/55.6; 415/55.7

[58] Field of Search ..... 417/423.1, 423.3, 423.5, 417/435, 251, 369; 415/55.5, 55.6, 55.7

[56] References Cited

U.S. PATENT DOCUMENTS

| | | | |
|---|---|---|---|
| 4,449,891 | 5/1981 | Kemmer | 415/55.6 |
| 4,776,315 | 10/1988 | Greiner | 123/509 |
| 4,854,830 | 8/1989 | Kozawa et al. | 417/423.1 |
| 4,865,522 | 9/1989 | Radermacher | 417/203 |
| 5,039,284 | 8/1991 | Talaski | 417/435 |

*Primary Examiner*—Richard A. Bertsch
*Assistant Examiner*—Charles G. Freay
*Attorney, Agent, or Firm*—Saul Schwartz

[57] ABSTRACT

In a fuel delivery apparatus including a canister in an automobile fuel tank, an electric fuel pump in the canister having two rotating elements from which three stages of pump operation are derived. A housing of the fuel pump has two cavities in which the two rotating elements are disposed. A first element has a web which divides the corresponding cavity into first and second stage pump chambers. The second element in the second cavity cooperates therewith in defining a third stage pump chamber. When the motor is on, vane pockets on one side of the web in the first pump chamber pump fuel from the fuel tank into the canister. Vane pockets on the other side of the web in the second pump chamber pump fuel from the canister to the third stage pump chamber. The second pump element pumps fuel into the interior of the fuel pump at a high pressure compatible with the requirements of internal combustion engine fuel injection systems. Vapor is separated from the fuel in the second stage pump chamber.

5 Claims, 4 Drawing Sheets

AUTOMOTIVE FUEL PUMP

FIELD OF THE INVENTION

This invention relates to automotive fuel pumps.

BACKGROUND OF THE INVENTION

Some automotive fuel systems have fuel delivery apparatus in the fuel tank of the vehicle including a canister and a fuel pump in the canister. If the canister is full of fuel, the pump inlet stays submerged under operating conditions which could otherwise expose the inlet, such as when the vehicle is parked on an incline with an almost empty fuel tank. Various proposals have been advanced for keeping the canister filled with fuel including discharging overage or return fuel from the engine back into the canister, aspirating fuel from the tank into the canister with jet pumps powered by either a fraction of the high pressure output of the fuel pump or return fuel from the engine, and adding a second pumping element dedicated to filling the canister and driven in tandem with the main pumping element of the fuel pump. A fuel pump according to this invention has two rotating elements from which three stages of pump operation are derived including a first or canister fill stage, a second or charging and vapor separation stage, and a third or primary boost stage.

SUMMARY OF THE INVENTION

This invention is a new and improved fuel pump in a canister of an in-tank fuel delivery apparatus of an automotive fuel system. The fuel pump according to this invention includes a tubular casing mounted in the canister, a pump housing in the casing, and an electric motor in the casing. The pump has two rotating elements connected to an armature shaft of the motor. A first of the two elements is a disc having radial vanes on opposite sides of a radial web of the disc. The first element fits in a first cavity of the pump housing and the radial web divides the first cavity into substantially separate first and second stage pump chambers. The first stage pump chamber communicates with the fuel tank and with the interior of the canister. First stage pockets on the first element in the first stage pump chamber effect a first or canister-fill stage of pump operation when the motor is on. The second stage pump chamber communicates with the interior of the canister and with a second cavity in the pump housing. Second stage pockets on the first element in the second stage pump chamber effect a second stage of pump operation when the motor is on whereby fuel from the canister is fed to a third stage inlet port in the second cavity and vapor is separated from the fuel and returned to the canister. The second cavity has a third stage discharge port to the interior of the casing. A second of the two elements of the pump fits in the second cavity and effects a third or high pressure boost stage of pump operation when the motor is on whereby fuel from the second stage is delivered at high pressure to the interior of the casing from which it is conducted to an internal combustion engine fuel injection system of the vehicle.

BRIEF DESCRIPTION OF THE DRAWING

Referring to FIGS. 1 and 2, a fuel tank (10) of an automobile, not shown, has a top wall (12) and a bottom wall (14). A fuel delivery apparatus (16) is disposed the tank (10) and includes a cylindrical plastic canister (18) near the bottom wall (14), a cover (20), and a plurality of resilient struts (22) telescoped between the cover (20) and the canister (18). The apparatus (16) is installed in the tank (10) through a hole (24) in the top wall (12) of the tank which is thereafter closed by the cover (20). The struts (22) bias the canister (18) against the bottom wall (14) and accommodate relative movement between the top wall (12) and the bottom wall (14) as the fuel tank expands and contracts in normal usage. A fuel pump (26) according to this invention is disposed in the canister (18).

Figure 2:
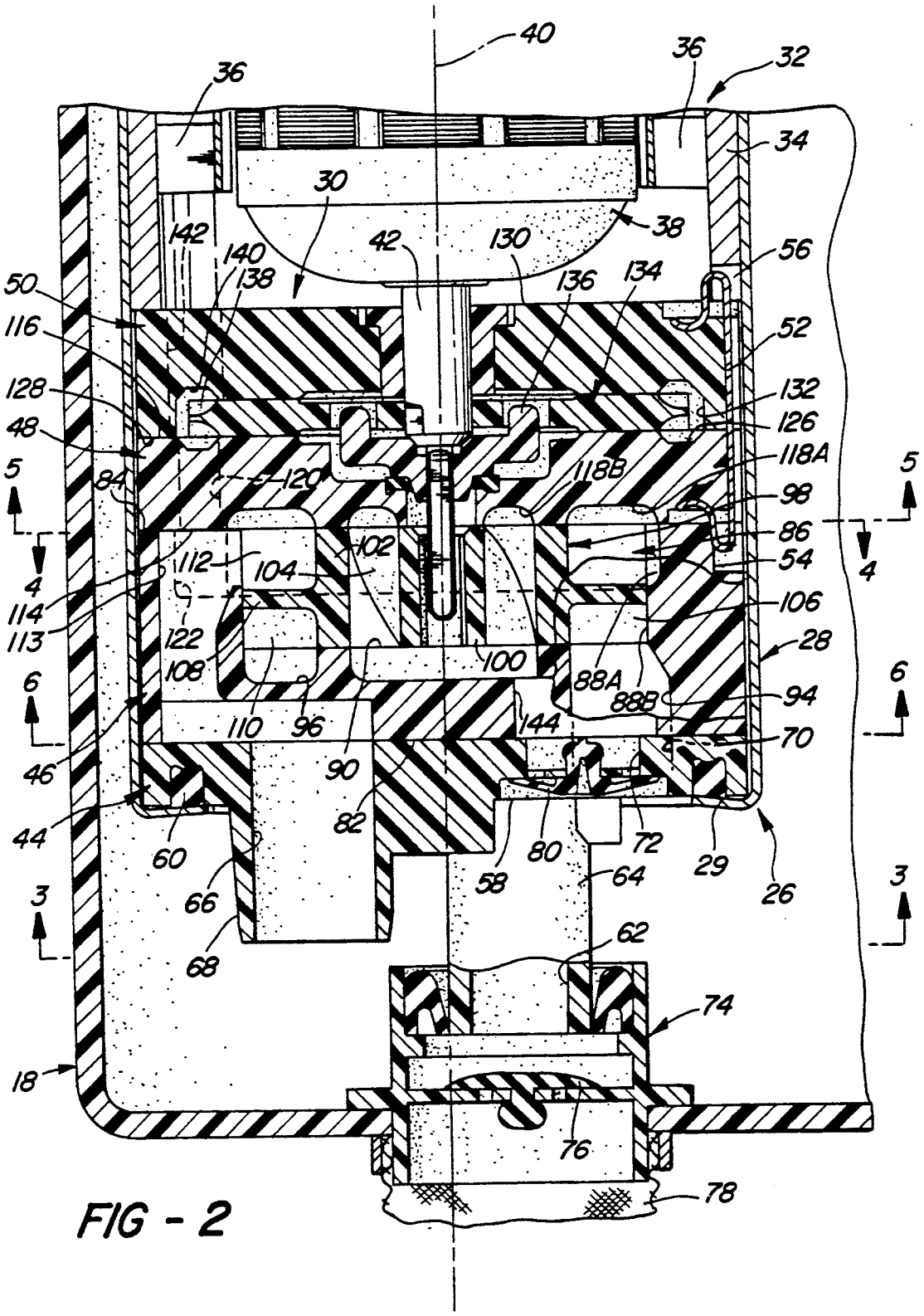
FIG. 2 is an enlarged, partially broken-away, fragmentary sectional view of the fuel delivery apparatus shown in FIG. 1 taken generally along the vertical centerplane of the fuel pump according to this invention.
Figure 6:
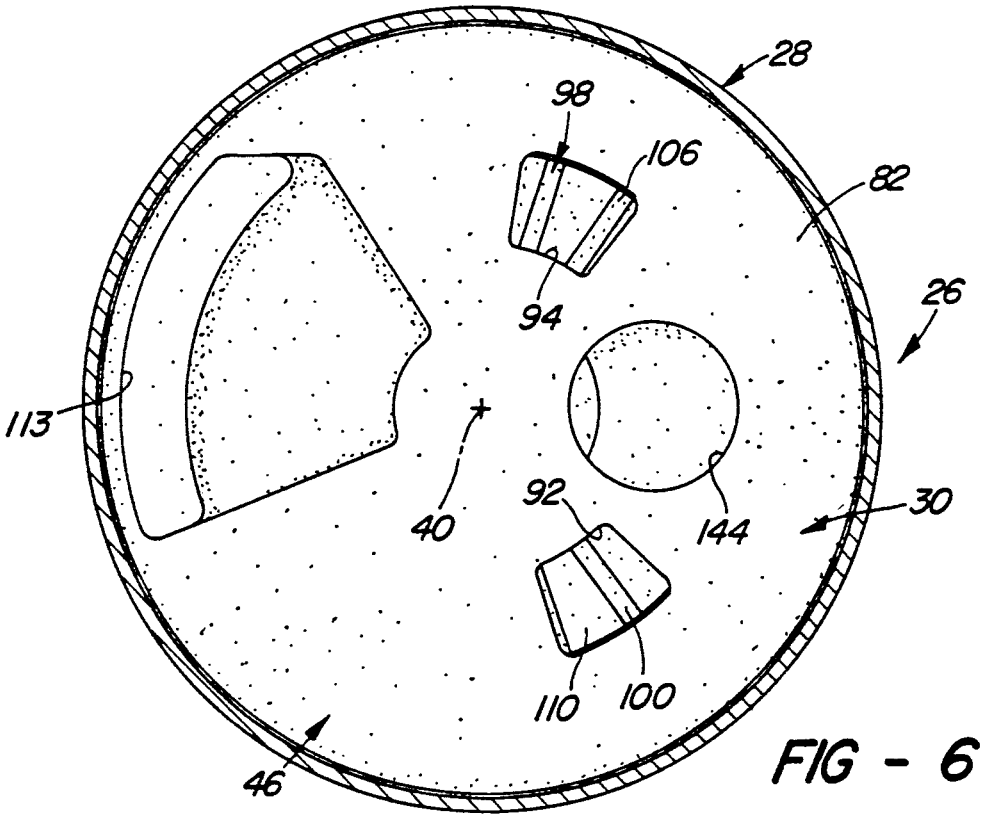
FIG. 6 is a sectional view taken generally along the plane indicated by lines 6—6 in FIG. 2.

As seen best in FIGS. 2 and 6, the fuel pump (26) includes a tubular aluminum casing (28) having an annular lip (29) around an open, lower end of the casing. The casing is supported vertically inside the canister (18) by conventional means, not shown. The open end of the casing (28) is closed by a pump housing (30). The opposite end of the casing is closed by a discharge end housing, not shown, such as described in U.S. Pat. No. 4,718,827, issued Jan. 12, 1988 to Sutton et al and assigned to the assignee of this invention. The discharge end housing has a high pressure discharge from the interior of the casing (28).

An electric motor (32) of the fuel pump is disposed between the pump housing (30) and the discharge end housing. The motor includes a cylindrical flux ring (34) closely received in the casing (28), a plurality of permanent magnets (36) inside the flux ring, and an armature (38) inside the permanent magnets. The armature is supported for rotation about a longitudinal centerline (40) of the casing (28) and includes a shaft (42). The casing is crimped over the discharge end housing to capture the pump housing (30), flux ring (34) and the discharge end housing.

The pump housing (30) consists of a stack of plastic discs including an inlet end disc (44), a first intermediate disc (46), a second intermediate disc (48), and a discharge end disc (50). A spring clip (52) holds the discs (48–50) together and, by reception in notches in the discs, maintains a predetermined angular relationship therebetween. One end of clip (52) fits in a notch (54) in the first intermediate disc to angularly locate the latter relative the disc (48). The other end of the clip (52) fits in a notch (56) in the flux ring, FIG. 2, to prevent rotation of the pump housing in the casing. A similar keying arrangement, not shown, may be provided between the inlet end disc (44) and the first intermediate disc (46).

The inlet end disc (44) has a circular end wall (58) facing the bottom of the canister (18). A seal ring (60) in a groove in the wall (58) seals against the lip (29) to close the lower end of the casing (28). The inlet end disc (44) further includes a first stage inlet opening (62) surrounded by an integral, long cylindrical flange (64) perpendicular to the wall (58), a second stage inlet opening (66) surrounded by an integral, short cylindrical flange (68), a first stage discharge opening (70), and a vapor discharge opening (72).

Figure 3:
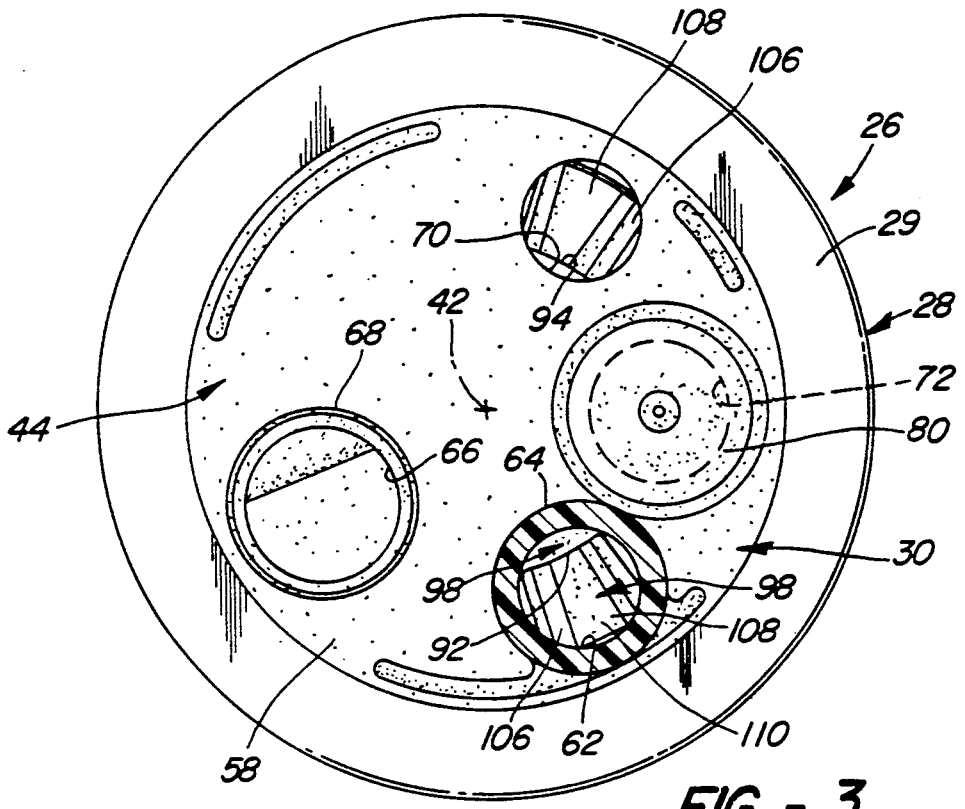
FIG. 3 is a sectional view taken generally along the plane indicated by lines 3—3 in FIG. 2.

A seen best in FIGS. 2-3, the long flange (64) plugs into a check valve housing (74) on the bottom of the canister (18). An umbrella element (76) in the check valve housing opens to permit fluid flow from the fuel tank (10) toward the first stage inlet opening and closes to prevent backflow in the opposite direction. A primary screen (78) outside the canister filters fuel flowing into the check valve housing. A second umbrella element (80) on the inlet end disc (44) in the vapor discharge opening (72) opens to permit vapor discharge into the canister and closes to prevent fluid and/or vapor flow in the opposite direction.

Figure 7:
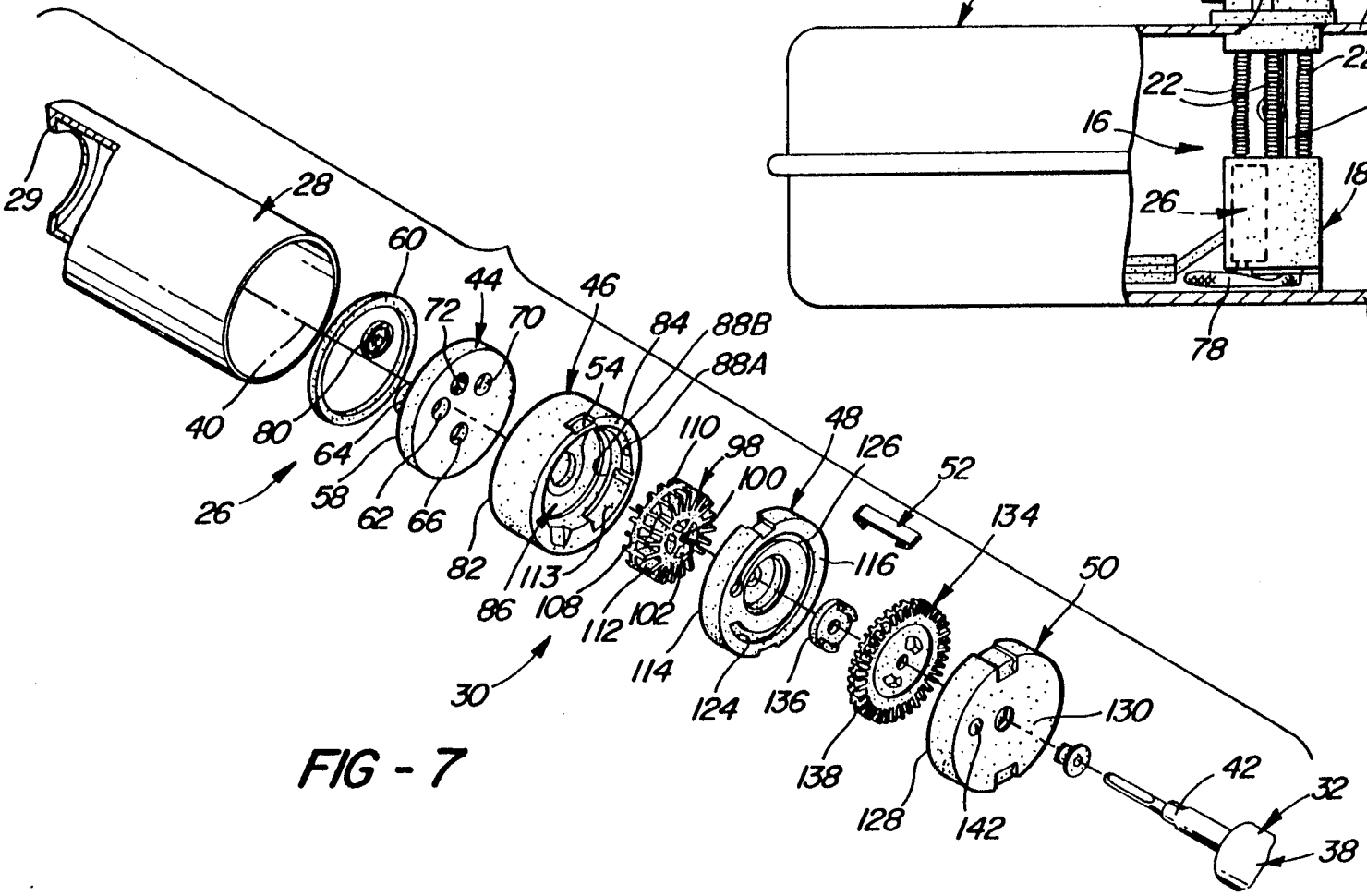
FIG. 7 is a partially broken-away, exploded perspective view of the fuel pump according to this invention.
Figure 4:
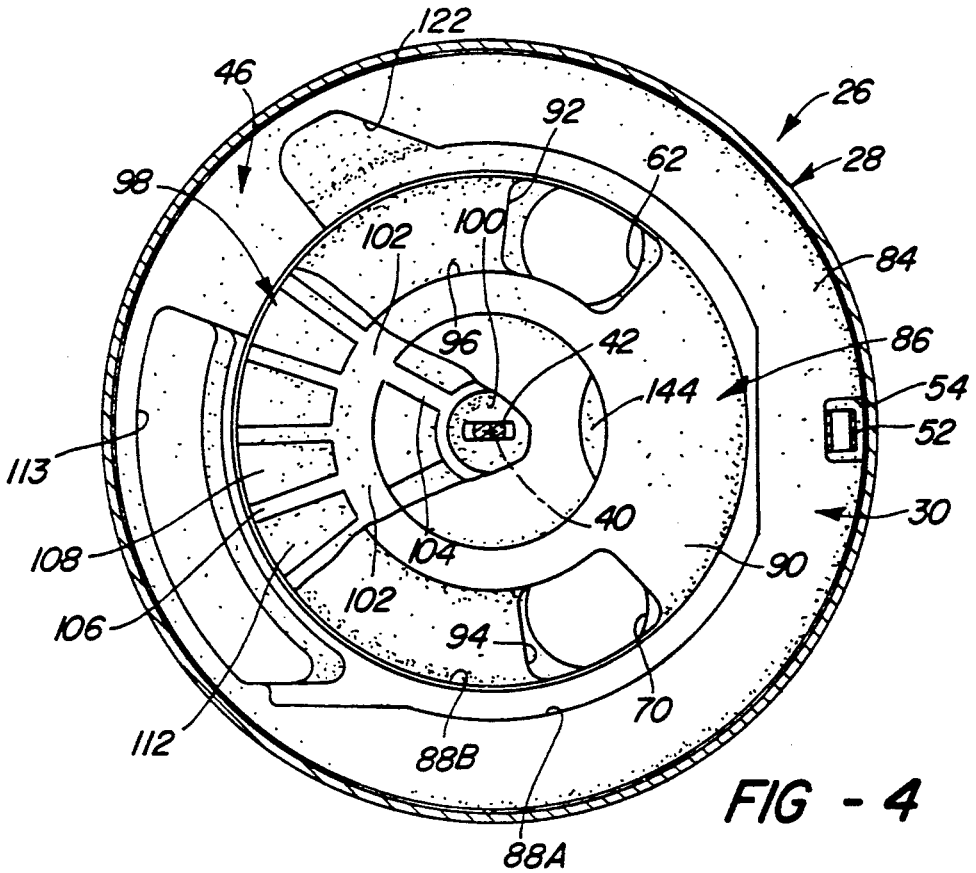
FIG. 4 is a sectional view taken generally along the plane indicated by lines 4—4 in FIG. 2.

Referring to FIGS. 4, 6 and 7, the first intermediate disc (46) has a circular end wall (82) facing the inlet end disc (44) and an opposite circular end wall (84) facing the second intermediate disc. A generally cylindrical cavity (86) in the end wall (84) has a stepped sidewall including a large diameter segment (88A) adjacent the end wall (84) and a small diameter segment (88B) adjacent a circular bottom (90) of the cavity. A first stage inlet port (92) in the first intermediate disc registers with the first stage inlet opening (62). A first stage discharge port (94) in the first intermediate disc registers with the first stage discharge opening (70). An arc shaped groove (96) in the bottom (90) of the cavity (86) in the first intermediate disc interconnects the first stage inlet and discharge ports (92-94).

A first element or impeller (98) of the pump (26), FIGS. 3 and 7, includes a hub (100), a cylindrical ring (102) connected to the hub by a plurality of integral, fan-like spokes (104), a plurality of integral vanes (106) projecting radially from the ring (102), and an integral, annular web (108) in a plane perpendicular to the longitudinal centerline (40). The web (108) and the portions of the vanes (106) on one side thereof cooperate in defining a plurality of first stage fluid pockets (110). The web (108) and the portions of the vanes (106) on the other side thereof cooperate in defining a plurality of second stage fluid pockets (112). U.S. Pat. No. 4,734,008, issued Mar. 28, 1988 to Roth and assigned to the assignee of this invention, describes a pump impeller having functionally similar fan-like spokes.

The depth or thickness of the impeller (98) is substantially equal to the depth of the cavity (86) and the diameter of the impeller is substantially the same as the diameter of the small diameter segment (88B) of the cavity sidewall. When the impeller (98) is disposed in the cavity (86), the web (108) is at the junction of the side wall segments (88A-B) and divides the cavity into a first stage pump chamber between the web and the bottom (90) of the cavity and a second stage pump chamber between the web and circular wall (84). The first stage fluid pockets (110) are in the first stage pump chamber and the second stage fluid pockets (112) are in the second stage pump chamber. The hub (100) is connected to the armature shaft (42) such that the impeller (98) rotates as a unit with the shaft about the centerline (40) when the motor is on. An arc-shaped second stage inlet port (113) in the first intermediate disc (46) registers with the second stage inlet opening (66) in the inlet end disc (44) to effect communication between the canister and the second stage pump chamber.

The second intermediate disc (48) has a circular end wall (114) facing the circular end wall (84) of the first intermediate disc and an opposite circular end wall (116) facing the discharge end disc (50). The end wall (114) covers the second stage pump chamber and has a groove, FIGS. 2 and 5, therein including an arc-shaped outside portion (118A) which is aligned with the second stage fluid pockets (112), an arc-shaped inside portion (118B) which registers with the spokes (104) of the impeller (98), and a connecting portion (118C) between the inside and outside portions.

Figure 5:
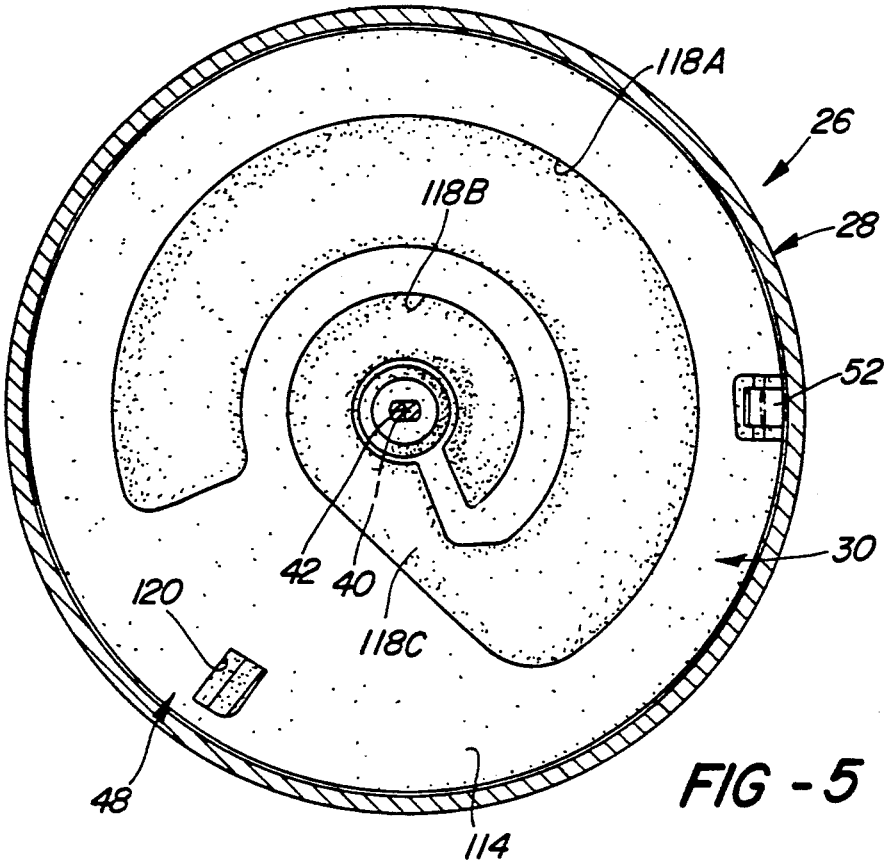
FIG. 5 is a sectional view taken generally along the plane indicated by lines 5—5 in FIG. 2.

The second intermediate disc (48) further includes a second stage discharge port (120), FIG. 5, which registers with a radially enlarged zone (122), FIG. 4, of the large diameter segment (88A) of the cavity sidewall in the first intermediate disc. The second stage discharge port (120) communicates with an elongated third stage inlet port (124) at one end of an arc-shaped groove (126), FIG. 7, in the opposite circular end wall (116) of the second intermediate disc.

The discharge end disc (50) has a circular end wall (128) facing the circular end wall (116) on the second intermediate disc and an opposite circular end wall (130) facing the motor (32). The circular end wall (116) on the second intermediate disc (48) covers a cylindrical cavity (132), FIG. 2, in the circular end wall (128) on the discharge end disc (50). The cavity (132) closely receives a second element or impeller (134), FIGS. 2 and 7, of the fuel pump (26).

The second impeller (134) is connected to the armature shaft (42) by a driver (136) for rotation as a unit with the shaft and the first impeller (98). The second impeller (134) has radial vanes which define a plurality of third stage fluid pockets (138) around the circumference of the impeller. The third stage pockets (138) register with the groove (126) and with a corresponding groove (140), FIG. 2, in the bottom of the cavity (132). A third stage discharge port (142) in the discharge end disc communicates with groove (140) and with the interior of the pump casing (28) around the motor (32).

The fuel pump (26) operates as follows. When the electric motor (32) is on, the armature shaft (42) rotates both impellers (98,134). Fuel from the tank (10) moves through the check valve housing (74) and first stage inlet opening (62) to the first stage inlet port (92). The first stage pockets (110) on the impeller (98) transport the fuel along the groove (96) in regenerative pump fashion and discharge it through the first stage discharge port (94) and the first stage discharge opening (70) into the canister (18).

At the same time, fuel from the canister moves through the second stage inlet opening (66) and the second stage inlet port (113) into the second stage pump chamber. The second stage pockets (112) on the impeller (98) transport the fuel along the outside groove portion (118A) in regenerative pump fashion from the second stage inlet port (113) to the second stage discharge port (120). The flow rate of fuel through the second stage pump chamber is always less than the flow rate through the first stage pump chamber so that the quantity of fuel in the canister is not depleted as long as the screen (78) remains submerged in fuel. The somewhat elevated pressure of the fuel at the second stage discharge port charges the third stage inlet port (124).

As the impeller (98) rotates, any vapor in the second stage pump chamber migrates around the edge of the cylindrical ring (102) through the connecting groove portion (118C) into the small diameter groove portion (118B). Then, with the aid of the fan-like spokes (104), the vapor is expelled into the canister through a vapor discharge port (144) in the end wall (82) of the first intermediate disc and through the vapor discharge opening (72) in the inlet end disc (44).

Fuel discharged from the second stage pump chamber through the discharge port (120) enters the third stage pump chamber defined around the fluid pockets (138) through the third stage inlet port (124), FIG. 7. The third stage fluid pockets (138) on the impeller (134) transport the fuel along the groove (126) and discharge the fuel into the interior of the pump casing (28) through the third stage discharge port (142) in the discharge end disc (50). The third stage fluid pockets (138) operate in regenerative pump fashion to boost the pressure of the fuel from the relatively low charging pressure at the third stage inlet port (124) to a high pressure at the third stage discharge port (142) compatible with the requirements of modern internal combustion engine fuel injection systems.

Figure 1:
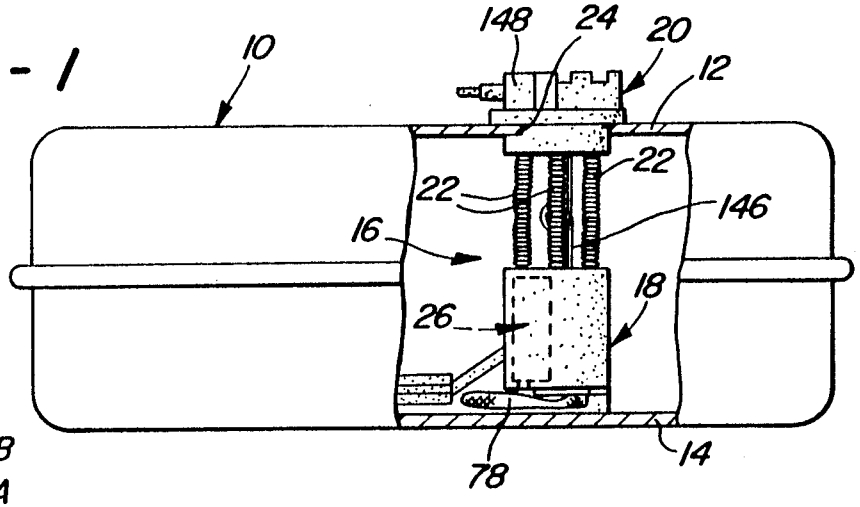
FIG. 1 is a partially broken-away elevational view of an automobile fuel tank having fuel delivery apparatus therein including a fuel pump according to this invention.

The interior of the pump casing (28) is connected to a flexible high pressure hose (146) of the delivery apparatus (16), FIG. 1, through the discharge end housing of the fuel pump (26) and appropriate fluid connectors, not shown. The hose (146) is connected to an internal combustion engine fuel injection system, not shown, through a fluid connector block (148) on the cover (20) of the delivery apparatus and through appropriate hoses and conduits, not shown, outside the tank (10). Return fuel from the fuel injection system is returned to the tank (10) through the connector block (148) and may be discharged into the tank or into the canister (18) through the struts (22) as described in U.S. Pat. No. 4,945,884, issued Aug. 7, 1990 to Coha et al and assigned to the assignee of this invention.

We claim:

1. In a fuel delivery apparatus including a canister in a fuel tank of a vehicle, a fuel pump in said canister comprising:

a tubular casing having an open end, an electric motor in said tubular casing having an armature shaft rotatable about a longitudinal centerline of said casing, a pump housing means in said casing closing said open end thereof, means defining a first cavity and a second cavity in said pump housing means, a first pump element in said first cavity connected to said armature shaft and rotatable therewith when said electric motor is on, a second pump element in said second cavity connected to said armature shaft and rotatable therewith when said electric motor is on, means on said first pump element and on said pump housing means defining a first stage pump chamber and a second stage pump chamber in said first cavity on opposite sides of said first pump element, means on said second pump element and on said pump housing means defining a third stage pump chamber in said second cavity, means connecting said first stage pump chamber to said fuel tank and to the interior of said canister, means connecting said second stage pump chamber to the interior of said canister and to said third stage pump chamber, means connecting said third stage pump chamber to the interior of said pump casing, means on said first pump element and on said pump housing means in said first stage pump chamber operative to pump fuel from said fuel tank into said canister when said electric motor is on, means on said first pump element and on said pump housing means in said second stage pump chamber operative to pump fuel from said canister into said third stage pump chamber when said electric motor is on, and means on said second pump element and on said pump housing means in said third stage pump chamber operative to pump fuel into said pump casing at a predetermined boost pressure when said electric motor is on.

2. The fuel pump recited in claim 1 wherein said first cavity in said pump housing means includes a generally circular bottom and a cylindrical sidewall having a small diameter segment adjacent said bottom and a large diameter segment adjacent said small diameter segment, and said means on said first pump element and on said pump housing means defining a first stage pump chamber and a second stage pump chamber in said first cavity on opposite sides of said first pump element includes, an annular web on said first pump element having a diameter generally equal to the diameter of said small diameter segment of said cavity sidewall, and means mounting said web on said first element in a plane perpendicular to the axis of rotation of said first pump element and generally aligned with the junction of said large and said small diameter segments of said cavity sidewall.

3. The fuel pump recited in claim 2 wherein said means on said first pump element and on said pump housing means in said first stage pump chamber operative to pump fuel from said fuel tank into said canister when said electric motor is on includes, a plurality of radial vanes on said first pump element cooperating with said annular web in defining a plurality of first stage pockets rotatable with said first pump element, and said means on said first pump element and on said pump housing means in said second stage pump chamber operative to pump fuel from said canister into said third stage pump chamber when said electric motor is on includes, a plurality of radial vanes on said first pump element cooperating with said annular web in defining a plurality of second stage pockets on the opposite side of said web from said first stage pockets and rotatable with said first pump element.

4. The fuel pump recited in claim 1 and further including:

means on said pump housing means and on said first pump element operative to eject vapor from said second stage pump chamber into said canister when said motor is on.

5. The fuel pump recited in claim 4 wherein said means on said pump housing means and on said first pump element operative to eject vapor from said second stage pump chamber into said canister when said motor is on includes, a plurality of fan-like spokes on said first pump element, and means for conducting vapor from said second stage pump chamber to said fan-like spokes and for conducting vapor from said fan-like spokes to the interior of said canister.

* * * * *